US008602851B2

(12) United States Patent
Lombardo et al.

(10) Patent No.: US 8,602,851 B2
(45) Date of Patent: Dec. 10, 2013

(54) CONTROLLED PENETRATION SUBPAD

(75) Inventors: Brian Scott Lombardo, Amherst, NH (US); Joseph Cianciolo, Methuen, MA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 1664 days.

(21) Appl. No.: 10/457,316

(22) Filed: Jun. 9, 2003

(65) Prior Publication Data

US 2004/0248508 A1 Dec. 9, 2004

(51) Int. Cl.
*B24D 11/00* (2006.01)

(52) U.S. Cl.
USPC ..... 451/537; 451/256; 451/526; 451/528; 451/533; 451/534; 451/539

(58) Field of Classification Search
USPC ..... 451/296, 526, 528, 533, 534, 537, 539, 451/256
See application file for complete search history.

(56) References Cited

U.S. PATENT DOCUMENTS 4,396,657 A * 8/1983 Ibrahim ..... 428/36.3
5,403,228 A 4/1995 Pasch
5,692,950 A 12/1997 Rutherford et al.
6,123,609 A 9/2000 Satou
6,179,950 B1 1/2001 Zhang et al.
6,213,858 B1 * 4/2001 Lombardo ..... 451/526
6,261,168 B1 * 7/2001 Jensen et al. ..... 451/527
6,273,800 B1 8/2001 Walker et al.
6,296,557 B1 10/2001 Walker
6,328,642 B1 12/2001 Pant et al.
6,331,139 B2 12/2001 Walker et al.
6,361,417 B2 3/2002 Walker et al.
6,572,463 B1 * 6/2003 Xu et al. ..... 451/526

FOREIGN PATENT DOCUMENTS

WO 0102136 1/2001
WO 0115864 3/2001
WO 0183167 11/2001

* cited by examiner

*Primary Examiner* — Joseph J Hail
*Assistant Examiner* — Shantese McDonald
(74) *Attorney, Agent, or Firm* — Blake T. Biederman

(57) ABSTRACT

Provided is a seamless polishing pad comprising a seamless polishing layer having a substantially uniform depth of penetration into a porous subpad. In one embodiment, the polishing pad comprises a polishing layer produced by applying to the subpad a hardenable fluid. In another embodiment, the subpad is coated with a barrier before coating with the hardenable fluid. In each embodiment, the depth of penetration of the polishing layer and/or barrier is substantially uniform. Also provided is a method of producing a seamless polishing pad comprising a seamless polishing layer having a substantially uniform depth of penetration into a porous subpad.

9 Claims, 7 Drawing Sheets

Figure #1
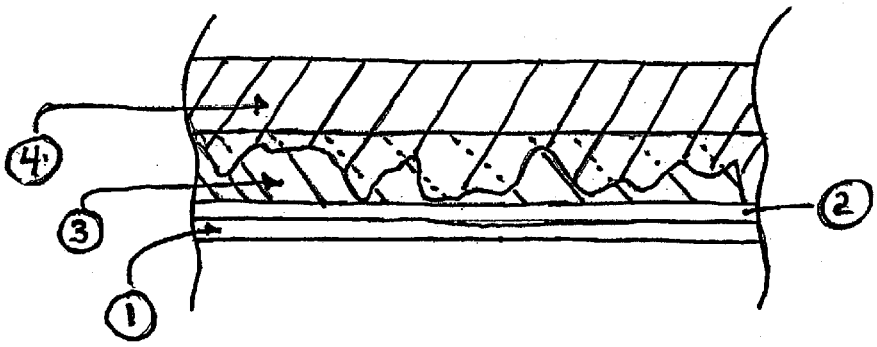
Figure #3
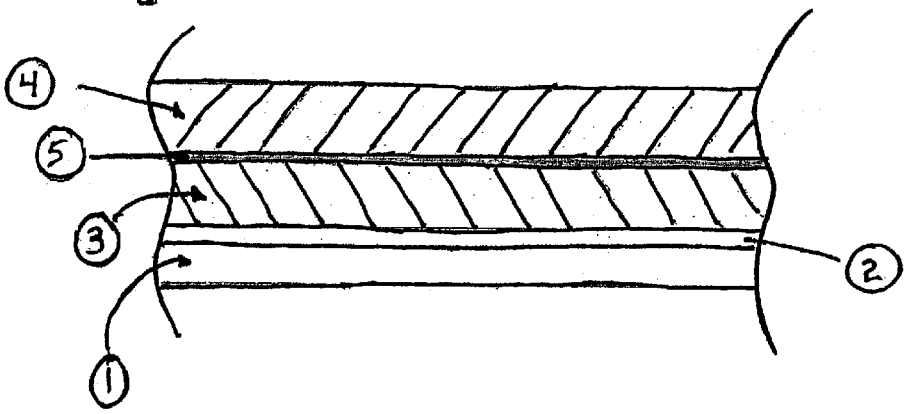

Figure #1A
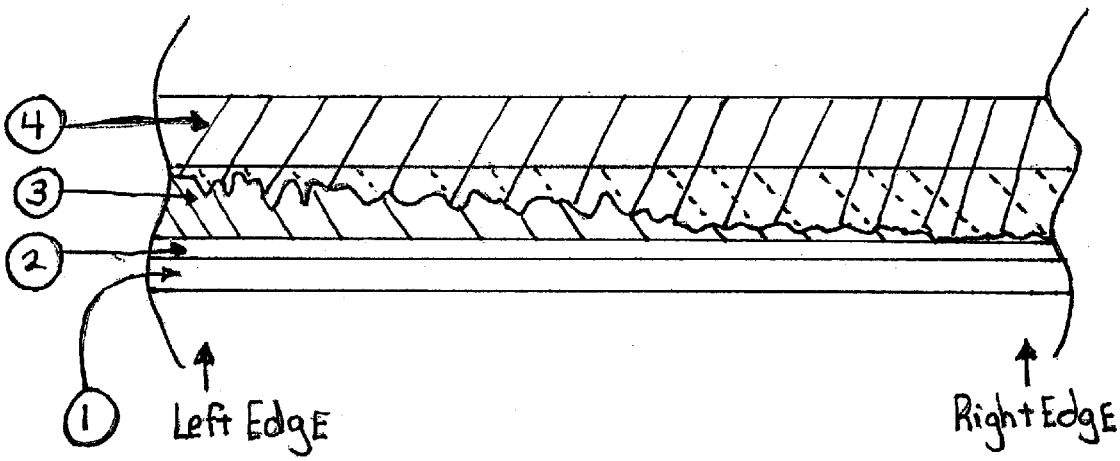

Figure #2
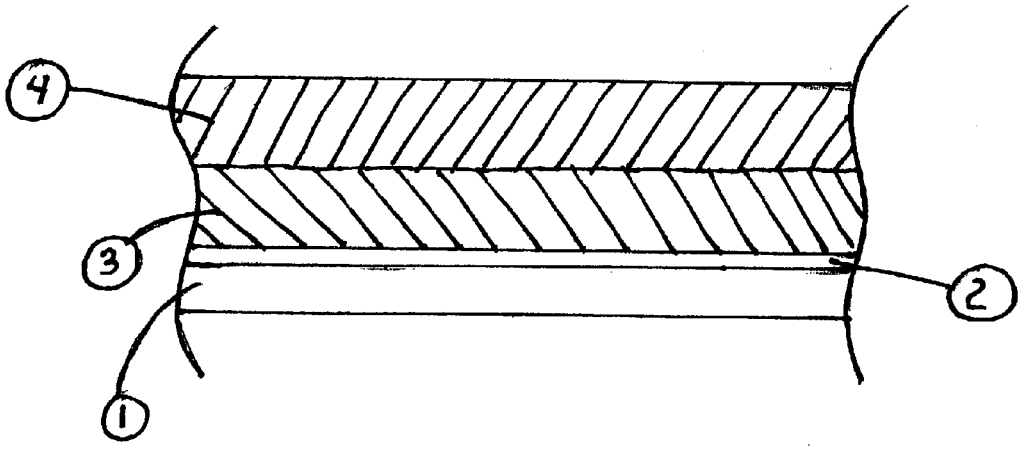

50% Penetration of Barrier into Subpad

100% Penetration of Barrier into Subpad

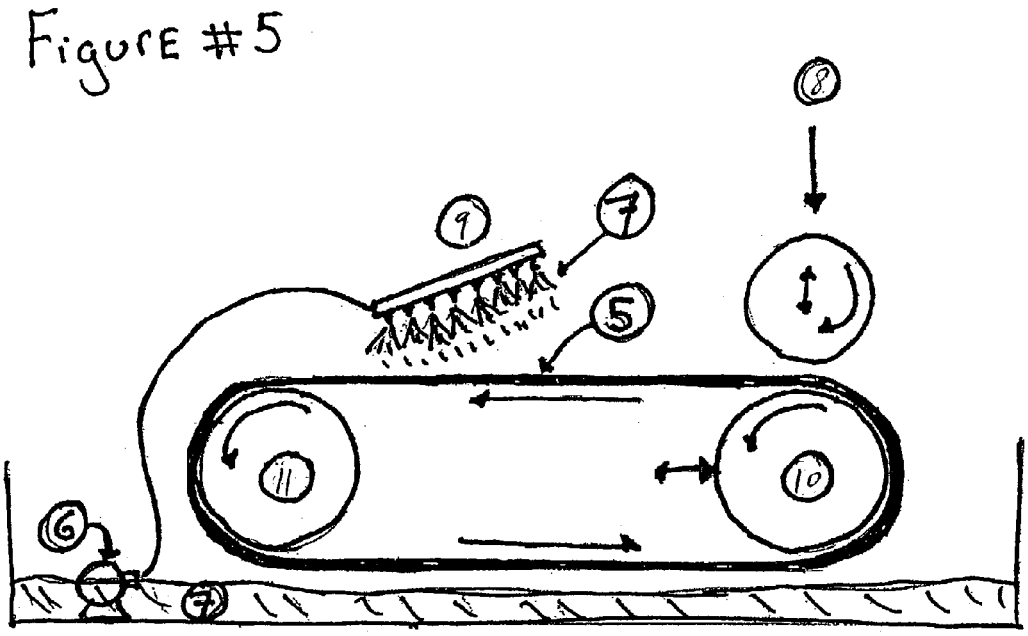
Figure 5. Simulated Belt Polish Apparatus
8. Pressure Roller
9. Water Drip Manifold
10. Tensioning Roller
11. Drive Roller
5. Polishing Belt/ Pad
6. Recirculation Pump
7. Water

CONTROLLED PENETRATION SUBPAD

FIELD OF THE INVENTION

This invention relates to a seamless polishing pad comprising a seamless polishing layer having a substantially uniform depth of penetration into a porous subpad.

BACKGROUND OF THE INVENTION

Silicon wafers are produced as precursors from which microelectronic semiconductor components are produced. The wafers are cleaved from cylindrical silicon crystals, parallel to their major surfaces, to produce thin disks, typically 20-30 cm in diameter. The resulting wafers must be polished to give flat and planar surfaces for proper formation of electronic components to form integrated chip semiconductor devices. Typically, a 20-cm diameter wafer will produce 100 or more microprocessor chips.

The designed size of such integrated chips is steadily decreasing, while the number of layers applied, e.g. by various sequences of depositing, patterning, and etching of features onto the silicon surface, is rising. Present semiconductors typically incorporate up to 7 or 8 metal layers, and it is expected that future designs will contain even more layers. The decrease in the size of circuitry and the increase in the number of layers applied are leading to ever more stringent requirements on the smoothness and planarity of the silicon and semiconductor wafers throughout the chip manufacturing process, since uneven surfaces may undermine the patterning process and the general integrity of the resulting circuit.

The standard wafer polishing technique in use at present is to position a wafer over a rotating polishing pad that is usually disk shaped, and is mounted on a large turntable. A chemical-mechanical polishing (CMP) slurry is usually applied to the surface of the pad, and the wafer is held in place by an overhead wafer carrier whilst being polished by the rotating pad and slurry. This is an adaptation of optical polishing technology used for polishing lenses, mirrors, and other optical components.

A significantly different approach is so-called Linear Planarization Technology (LPT), wherein the polishing pad is mounted onto a supporting belt. One such pad and belt combination, described in EP-A-0696495, comprises a conventional flat polyurethane polishing pad glued to a lower belt of sheet steel or other high strength material.

A disadvantage of such prior art polishing pads is that they often contain seams. A polishing pad is often subject to delamination at its seams. Moreover, the seams can mar the surface of a polished article, and can limit the ability of a pad to polish the article to a high degree of planarity. A large pad made from two or more smaller pads will have one or more seams at the junctions of the smaller pads. See, e.g., U.S. Pat. No. 6,179,950 (Zhang et al). Also, whenever the ends of an elongated pad are joined to create a belt, the belt contains a seam at the junction. See, e.g., WO 01/83167 (Eppert et al.)

One way to solve the seam problem is to directly create the polishing layer in the size and shape desired. That may be accomplished by, e.g., casting a continuous, seamless polishing layer having the desired dimensions. See, e.g., WO 99/06182 (Dudovicz et al).

Wafer polishing using either the rotating disk or endless belt techniques typically involves stacking a hard polishing layer onto a rigid support. For example, the platen beneath a rotating polishing disk typically comprises steel, and an endless polishing belt typically comprises a stainless steel supporting belt. For that reason, it is often desirable to incorporate into the polishing pad a relatively soft, compressible subpad below the polishing layer. See, e.g., U.S. Pat. No. 5,403,228 (Pasch). In use, the compressible subpad is sandwiched between the polishing layer and the steel platen or belt support, which allows the hard polishing layer to better conform to the surface of the wafer.

According to prior art construction methods, where seams can be a problem, a polishing layer is attached to a compressible subpad using, e.g., double sided tape, and the stacked pad is attached to the steel platen or stainless steel belt in the same manner. We have found that when a seamless polishing layer is created directly over a compressible subpad by coating it with a hardenable fluid, the hardenable fluid generally penetrates into the porous subpad. This causes air to be displaced from the subpad into the hardenable fluid, which can create voids in the hardened polishing layer. Moreover, the fluid often penetrates to different depths at different locations throughout the subpad, and from subpad to subpad. Consequently, the hardened polishing layer created in these pads varies in thickness, as does the thickness of the unpenetrated portion of the subpad below the hardened polishing layer. The polishing layer voids and the variability in the thickness of the hardened polishing layer and of the subpad material thereunder cause a corresponding variability in the compressibility of the polishing pad. As discussed earlier in connection with the seam problem, when the properties of the polishing pad are not uniform, it can limit the pad's ability to impart uniform levels of smoothness and planarity to a polished item, whether it be a silicon wafer, an optical component, or another article.

Consequently, a need exists for a polishing pad including a seamless polishing layer having a substantially uniform depth of penetration into a porous subpad, and for a method of making the seamless, porous subpad-containing polishing pad from a hardenable fluid.

BRIEF SUMMARY OF THE INVENTION

The invention provides a method of preparing a seamless polishing pad that solves the problem of nonuniform penetration of a hardenable fluid into a porous subpad. The invention also provides a seamless polishing pad comprising a polishing layer having a substantially uniform depth of penetration into a porous subpad.

More specifically, the invention relates to a seamless polishing pad that includes a relatively soft, compressible subpad below a relatively hard polishing layer. The polishing pad includes a seamless polishing layer created by coating the subpad with a hardenable fluid, wherein the subpad, prior to coating, comprises open areas (i.e., the subpad is porous). According to the invention, the open areas of the subpad are either not filled by the hardenable fluid, or are filled to a depth that is substantially uniform across the subpad. Consequently, the invention provides a seamless polishing pad including a porous subpad having a seamless polishing layer coated thereon, wherein the depth of penetration of the polishing layer into the subpad is substantially uniform. Moreover, the polishing pad is often substantially uniformly compressible.

A substantially uniform depth of penetration may be achieved by applying a barrier to the subpad before coating the subpad (and barrier) with the hardenable fluid. Preferably, the barrier possesses the following properties: (a) it adheres well to both the subpad and to the polishing layer, (b) it substantially prevents the hardenable fluid from penetrating into the subpad, and (c) it does not substantially alter the compressibility of the subpad.

According to the method of the present invention, a seamless polishing pad includes a polishing layer having a substantially uniform depth of penetration into a porous subpad can be prepared by (a) providing a porous subpad, (b) applying a barrier to the subpad, and (c) coating the barrier-coated subpad with a hardenable fluid to form a seamless polishing layer. As compared to a polishing pad formed of the same materials according to the same method, but omitting step (b) (i.e., a polishing pad not including a barrier), a polishing pad prepared according to the method of the present invention comprises a polishing layer whose depth of penetration into the porous subpad is more uniform.

As compared to a polishing pad formed from the same materials according to the same method, but omitting step (b), a polishing pad prepared according to the inventive method is often more uniformly compressible.

BRIEF DESCRIPTION OF THE DRAWINGS

FIG. 1 is a cross sectional view of a polishing pad that illustrates the problem of nonuniform penetration of the polishing layer into the subpad;

FIG. 1*a* is another cross sectional view of a polishing pad that illustrates the problem of nonuniform penetration of the polishing layer into the subpad;

FIG. 2 is a cross sectional view of the polishing pad of the present invention;

FIG. 3 is a cross sectional view of another embodiment of the polishing pad of the present invention;

FIG. 5 depicts a belt roller apparatus that can be used to test the delamination resistance of a polishing belt;

DETAILED DESCRIPTION

Figure 4:
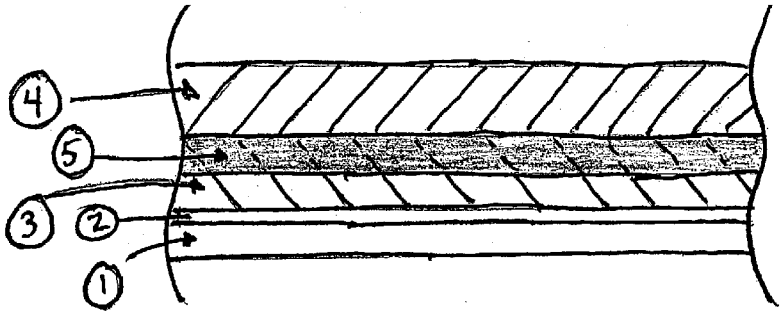
FIG. 4 is a cross sectional view of another embodiment of the polishing pad of the present invention.

FIGS. 1 and 1*a* depict, in cross section, a polishing pad comprising a porous subpad 3 and a polishing layer 4, in which the polishing layer 4 has penetrated into the subpad to a nonuniform depth. The polishing pad is mounted onto a substrate 1. In FIG. 1, the depth of penetration is random throughout the pad. In FIG. 1*a*, the depth of penetration is greater on the right side of the pad, and lesser towards the left. In both cases, the properties of the polishing pads would vary based on the depth of penetration, and would make it difficult to accurately and precisely prepare a seamless polishing pad having desired properties throughout.

The present invention solves that problem. Depicted in cross section in FIG. 2 is an embodiment of the seamless polishing pad. It should be noted at this point that the term "seamless polishing pad," as used herein, refers to both seamless polishing disks and to seamless polishing belts. Moreover, the term "polishing disk" refers generally to any polishing pad that is used on a rotating platen, regardless of the pad's shape. In other words, even though most polishing pads used on rotating platens are in fact disk-shaped, the term "polishing disk" as used herein is not confined to polishing pads of that shape. It should also be noted that although the polishing belt is a continuous loop in its lengthwise direction, whereas the polishing disk has discrete perimeter boundaries, the belt and disk appear identical in cross section. Consequently, the Figures herein that depict "polishing pads" accurately illustrate both the polishing belt and polishing disk embodiments of the invention.

As shown in FIG. 2, the elements of the seamless polishing pad are porous subpad 3 and seamless polishing layer 4, wherein polishing layer 4 is formed by applying a hardenable fluid to the surface of subpad 3. Polishing layer 4 has penetrated into subpad 3 a substantially uniform distance. Also shown in FIG. 2 are substrate 1 and adhesive 2, two optional elements of the seamless polishing pad. In the disk embodiment, substrate 1 is a support material, such as the rotating platen, but in the belt embodiment, substrate 1 is a belt constructed of a rigid substance, such as stainless steel.

Another embodiment of the seamless polishing pad is depicted in cross section in FIG. 3. The subpad 3, polishing layer 4, and substrate 1 are as described in connection with FIG. 2. In addition to the subpad 3 and polishing layer 4, the polishing pad includes as an additional element barrier 5, which is applied to the subpad before subpad 3 and is coated with the hardenable fluid to create polishing layer 4. In this embodiment, the barrier 5 and polishing layer 4 have penetrated into subpad 3 a substantially uniform distance.

Taking each of these elements in turn, subpad 3 may include any suitable compressible material. Prior to coating with barrier 5 and/or polishing layer 4, subpad 3 should include open areas, such as pores. Moreover, it is often preferable that the subpad be substantially uniformly compressible.

Suitable materials for subpad 3 are well known in the art, and include polymer foams and fibers. Preferably, subpad 3 comprises a non-woven material, such as non-woven synthetic and natural fibers, including polyesters, polyamides, polyurethanes, polyolefins, fluoropolymers, cotton, wool, and combinations thereof. By way of example, a material suitable for use as subpad 3 is the 817 subpad material sold by Thomas West, Inc. (Sunnyvale, Calif.).

The typical dimensions of subpad 3 are shown in FIGS. 2 and 3 in relative terms compared to the other elements of the polishing pad. The width of subpad 3 is typically less than or equal to the width of substrate 1. As previously mentioned, the polishing belt is a continuous loop in the lengthwise direction, whereas the polishing disk has discrete perimeter boundaries. Consequently, in the polishing disk embodiment, the length/diameter of subpad 3 also is typically less than or equal to the length/diameter of substrate 1. In the polishing belt embodiment, however, the length of subpad 3 (measured by its inner circumference) is preferably substantially equal to the length of substrate 1 (measured by its outer circumference), though the length of subpad 3 also may be less than the length of substrate 1. Prior to coating with barrier 5 or polishing layer 4, subpad 3 is typically from about 0.001 to about 0.2, more often from about 0.01 to about 0.1, inches in thickness, although any suitable thickness may be used. When the subpad is equipped with an adhesive layer on the bottom and/or top surface, the thickness of the subpad does not include the thickness of the adhesive layer(s).

The barrier 5 typically is a material whose viscosity increases after it is applied to subpad 3. However, any material having the following properties, when applied to subpad 3, may be used as barrier 5: (a) the barrier should adhere strongly to both subpad 3 and polishing layer 4, (b) it should substantially prevent polishing layer 4 from penetrating past it into subpad 3, and (c) it should not substantially alter the compressibility of subpad 3.

Although other modes of adhesion are possible, it is preferred that barrier 5 be capable of adhering to subpad 3 and to polishing layer 4 via chemical adhesive forces and/or mechanical locking interactions, in order to promote strong adhesion between the elements of the polishing pad. The barrier's chemical adhesive forces will vary depending on the composition of subpad 3 and polishing layer 4. Materials capable of strong adhesion to the various components of subpad 3 and polishing layer 4 are well known to those of skill in the art. For example, when subpad 3 comprises polyester fibers, and polishing layer 4 comprises polyurethane, then a polymer adhesive, such as a polyurethane, acrylic, methacrylic, urethane, cyanoacrylate, vinylic, epoxy, or styrenic based adhesive, will often provide good chemical adhesion between those polymeric elements. Also suitable are hot melts, contact cements, anaerobics (acrylics), UV curables, emulsions (white glues), sealants (silicones, acrylics, urethanes, butyl and polysulfides, etc.), modified phenolics, plastisols (modified PVC dispersions), rubber adhesives (solution, latexes), polyvinyl acetates (emulsions), specialty adhesives (pressure sensitive, cohesive self-seal, fugitive, heat seal, foam & fabric, etc.), and labeling adhesives (resin adhesives, latex adhesives, etc.). Polyurethane and acrylic adhesives are preferred.

Another way to maximize chemical adhesion is to employ a barrier 5 that can chemically bond to polishing layer 4. For example, if both barrier 5 and the hardenable fluid that will create polishing layer 4 initially includes reactive molecules, then cross-reaction between the elements will be possible if the hardenable fluid is coated onto barrier 5 before the latter has fully reacted.

Subpads having a textured, rather than smooth, surface topography may be used to maximize mechanical locking interactions. For example, a subpad comprising nonwoven fibers may be used. Alternatively or additionally, the surface of the subpad may be modified (e.g., by buffing, molding, embossing, cutting, scoring, etc.) to add such texture. In a preferred embodiment, barrier 5 includes a material that is fluid enough to fill the lowermost textured portions of subpad 3 when it is applied, but viscous enough to adopt the texture of subpad 3. That combination of properties can be found in materials, such as hardenable fluids, which can be applied at relatively low viscosities, but which increase in viscosity rapidly after application. Adhesives that increase in viscosity after application, such as adhesives applied in volatile solvents, are suitably used as barrier 5. Examples include polyurethane adhesives, such as D2596H Adhesive and D2597 Crosslinker, available from DELA, Inc. (Ward Hill, Mass.), and acrylic adhesives, such as Chemlok® 213, available from Lord® Corporation (Cary, N.C.). Alternatively or additionally, the surface of barrier 5 may be modified to add such texture.

Barrier 5 should substantially prevent polishing layer 4 from penetrating into subpad 3. This requires that barrier 5 be applied in a continuous layer, leaving substantially no open areas through which the polishing layer may contact subpad 3. Materials that can be applied in a continuous layer are well known to those of skill in the art. For example, polymers, such as polymeric adhesives, are generally suitable for creating barrier 5.

Barrier 5 should substantially alter the compressibility of subpad 3. Thus, it is preferred that barrier 5 be applied to subpad 3 in a manner such that barrier 5 penetrates into subpad 3 to a substantially uniform depth. Such application methods are well known to those of skill in the art, and include spray coating, dipping, doctor blading, knife over roll coating, extrusion, injection molding, and coating with a material of high viscosity suspended or dissolved in a low viscosity fluid, all optionally followed by running the coated subpad through nip rollers to further work barrier 5 into subpad 3. If barrier 5 is applied as a hardenable fluid, it should be applied in a manner such that the entire subpad is coated evenly with material at substantially the same viscosity. Although not common, it is possible that a material used as barrier 5 could have substantially the same compressibility as subpad 3. In that case, even if barrier 5 penetrated into subpad 3 to variable depths, it would not substantially alter the subpad's compressibility.

Figure 4A:
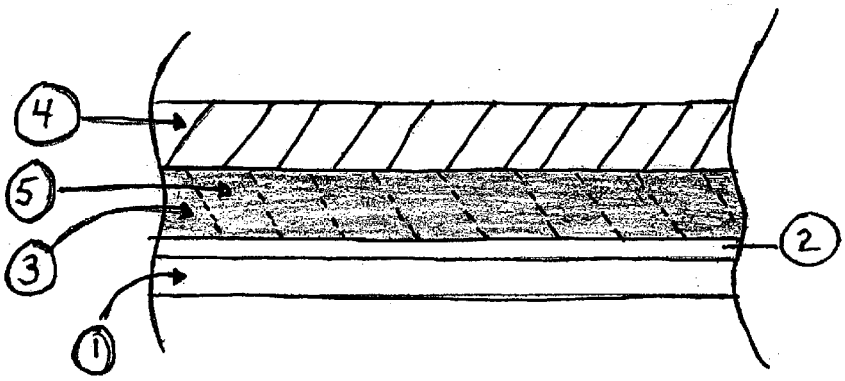
FIG. 4*a* is a cross sectional view of another embodiment of the polishing pad of the present invention.

Although barrier 5 may be applied in any suitable thickness, a typical thickness will be between about 1 μm and about 0.2 inches, often between about 10 μm and about 0.1 inches, and more often between about 0.001 and about 0.01 inches. Barrier 5 may penetrate into subpad 3 to any suitable depth. However, because barrier 5 will typically be less compressible than subpad 3, and because the function of subpad 3 in the polishing pad is to provide a cushion for the polished article, it is generally preferred that barrier 5 penetrate into subpad 3 to a limited extent only. Yet to maximize adhesion, it is generally preferred that barrier 5 penetrate at least some distance into subpad 3. For example, the barrier 5 may penetrate from about 0 to about 0.002 inches into subpad 3. If a reduced cushioning effect is acceptable or desirable, barrier 5 may penetrate deeper into subpad 3, and may even penetrate all the way to the bottom of subpad 3. FIG. 4 depicts, in cross section, a polishing pad wherein the barrier 5 has penetrated about half way into subpad 3. FIG. 4*a* depict, in cross section, a polishing pad wherein the barrier 5 has penetrated all the way into subpad 3. By selecting the identity and depth of penetration of barrier 5, the degree of cushioning provided by the polishing pad can be tailored.

The seamless polishing layer 4 includes a hardenable fluid coated onto subpad 3. The hardenable fluid may be coated directly onto subpad 3 (e.g., FIG. 2 embodiment) or onto barrier 5-coated subpad 3 (e.g., FIG. 3 embodiment). By "hardenable fluid" is meant a fluid that is sufficiently flowable to allow it to be evenly coated onto subpad 3, but which provides a solid, durable, seamless polishing layer. In general, the hardenable fluid may comprise one or more reactive molecules (e.g., a prepolymer, monomer, resin, oligomer, etc.) and one or more reaction initiators (e.g., a polymerization initiator, curative, catalyst, hardener, etc.) therefor. Alternatively, the reaction may be initiated using light and/or heat. The reactive molecule(s) and reaction initiator(s) may optionally be dissolved in a suitable solvent. A hardenable fluid includes one or more reactive molecules will often possess the desired flowability and coatability characteristics at the beginning of the reaction, as well as the desired solidity, durability, and seamlessness when fully reacted. The hardenable fluid may optionally comprise one or more non-reactive molecules. For example, a polymer may be suspended or dissolved in a suitable solvent and coated onto subpad 3. Upon contact with subpad 3 and/or barrier 5, the polymer may precipitate to create polishing layer 4.

Polishing layer 4 also should adhere strongly to subpad 3 (e.g., FIG. 2 embodiment) and/or to barrier 5 (e.g., FIG. 3 embodiment), so that the polishing pad resists delamination during use. As previously described in connection with barrier 5, delamination can be inhibited by maximizing the chemical adhesion and/or mechanical locking interactions between polishing layer 4 and subpad 3 and/or barrier 5. The same strategies and techniques discussed above apply to polishing layer 4.

Preferably, the polishing pad resists delamination to such a degree that it is not possible to peel polishing layer 4 away from subpad 3 and/or barrier 5 without destroying the integrity of the individual layers. In other words, the cohesive forces of one or more elements of the polishing pad (the subpad 3, seamless polishing layer 4, and optionally barrier 5) fail before the adhesive forces connecting the elements fail.

The resistance to delamination of a polishing belt may be tested in the following manner. The polishing belt can be run on a belt roller apparatus as shown in FIG. 5. For example, the belt can be run at about 300 feet per minute over rollers having a diameter of about 12 inches. All the while, pressure may be applied to the top of the polishing belt by means of a urethane roller, weighing about 125 pounds, resting on top of the belt as it runs. When the contact area of the roller is about 12 inches by about 0.25 inch, the applied pressure is about 40 psi. Finally, a liquid such as water or CMP slurry may be continuously poured onto the full width of the belt at the rate of about one liter per minute. Preferably, a polishing belt will run on such an apparatus for at least about 50 hours without showing signs of delamination (i.e., there will be no visible gap developing between the belt elements). More preferably, the polishing belt will run for at least about 75 hours without showing signs of delamination. Most preferably, the polishing belt will run for at least about 100 hours without showing signs of delamination.

Preferably, seamless polishing layer 4 comprises solid or cellular polyurethane, such as polyurethane having a Shore-D hardness of about 10 to about 90, though other suitable hardnesses may be used. The hardenable fluid used to create polishing layer 4 preferably includes a polyurethane prepolymer and a curative therefor. Alternatively, polishing layer 4 may include any thermoset or thermoplastic polymer, copolymer, or blend having desired properties such as sufficient flexibility, abrasion resistance, and water and chemical resistance. Examples of possible polymers include but are not limited to polyureas, polyamides, polyesters, polycarbonates, polyethers, polyacrylates, polymethacrylates, substituted vinyl polymers, polyacrylamide, polyacrylonitrile, polyketones, silicones, saturated and unsaturated polymeric hydrocarbons, fluoropolymers, and epoxy resins.

The preferred method of coating subpad 3 (with or without barrier 5) with the hardenable fluid that will create seamless polishing layer 4 is casting. As is known to those of skill in the art, casting involves filling a mold with a hardenable fluid. The mold is typically filled from an open top or through injection points at the bottom and/or sides. One feature of casting that is particularly advantageous is that it permits the polishing layer 4 to combine with substrate 1 to create a continuous exterior surface of the polishing pad, completely encapsulating and substantially sealing subpad 3 against water penetration. Thus, the subpad 3 is prevented from contacting the corrosive slurry used in the chemical-mechanical polishing of silicon or semiconductor wafers. If portions of the subpad become wet, its compressibility will change. The subpad's compressibility can change further if the corrosive slurry degrades the subpad. If the slurry degrades the adhesiveness between the layers of the polishing pad, such as by degrading adhesive 2, delamination can occur.

Preferably, a casting method is used wherein the hardenable fluid is applied rapidly and continuously to all areas of the subpad 3 simultaneously. In this way, the potential for nonuniform penetration into subpad 3 is reduced. Alternatively or additionally, the time between combining the reactive molecule(s) and the reaction initiator(s) and applying the hardenable fluid to any given portion of the subpad may be equalized. Moreover, the properties (e.g., composition, temperature, etc.) of the hardenable fluid may be modified to ensure that its viscosity does not substantially rise during the period that it is applied to the subpad. These casting methods may also be used to prepare a polishing pad with or without a barrier 5 (e.g., as shown in FIGS. 2 and 3). A polishing pad prepared according to the above casting methods includes a polishing layer whose depth of penetration into the porous subpad is more uniform than the depth of penetration of the polishing layer in a polishing pad formed from the same materials, but using a different casting method. Moreover, a polishing pad prepared according to the above casting methods will often have an improved uniformity of compressibility as compared to a polishing pad formed from the same materials, but using a different casting method.

Other suitable methods of coating subpad 3 with a hardenable fluid to create polishing layer 4 include reaction injection molding, spray coating, foam blowing, foam coating, compression molding, and extrusion. As discussed above in connection with the casting method of forming polishing layer 4, each of these methods may be used to encapsulate and seal subpad 3 against water penetration.

Prior to, during, or after formation thereof, seamless polishing layer 4 may be modified to provide optimum polishing performance. Polishing layer 4 may include a porous or microcellular structure in portions or throughout the layer. The microcellular structure may be formed by any suitable technique, such as by blowing, frothing, addition of hollow microelements, particle sintering, etc. Polishing layer 4 may comprise at least one layer of partially fused polymeric particles, or two or more thermoplastic polymers of different melting points. Abrasive particles or fibers may be added to polishing layer 4. In addition, the polishing surface may have micro or macro texturing, grooves, or discontinuities. It may have areas of hard and soft polymer, may have areas of transparent and opaque material, or may have areas of raised and lowered features. It may be formed with grooves (for example, extending in the running direction of the belt) to distribute and remove wet slurry and abraded particles generated during the polishing process and to reduce hydroplaning for more consistent contact between the polishing layer and the polished article. Slurry can be removed from the grooves using any suitable method, including but not limited to the use of one or more high pressure water jets, rotating fine brushes or hard non-metallic (e.g. ceramic) styli.

As shown in FIGS. 2 and 3, optional elements of the seamless polishing pad are substrate 1 and adhesive 2. Any suitable adhesive may be used, such as pressure sensitive adhesive. For example, UHA 8791 sold by Avery Dennison Corporation (Pasadena, Calif.) may be used to adhere subpad 3 to substrate 1. By way of example, many commercially available subpads are equipped with a suitable adhesive backing, such as the 817 subpad material from Thomas West, Inc. (Sunnyvale, Calif.).

In the polishing disk embodiment, substrate 1 can be the rotating platen itself. In that case, the bottom of subpad 3 would be attached via adhesive 2 to the top of the rotating platen in use. Alternatively, substrate 1 can be any flat support material, such as a polymeric or plastic sheet. In that case, the support material, rather than the subpad, would be attached to the top of the rotating platen in use.

Turning now to the belt embodiment, because substrate 1, in operation, contacts the mechanical rollers that turn the belt, it is preferred that substrate 1 comprise a durable material such as stainless steel. The belt substrate is typically 1-4 meters in length (often between 1.5 and 3 meters), measured as the inner circumference of the belt loop, 0.1-1 meter in width (often 0.2-0.6 meters), and 0.01-0.6 cm thick. An additional layer of protective material, such as a polyethylene liner material, can be affixed to the inside surface of substrate 1, to protect substrate 1 and the hardware of the polishing apparatus.

The seamless polishing pad can be used to polish any type of material or layer in any of various polishing steps in semiconductor manufacturing. Typical materials to be polished include but are not limited to silicon, polysilicon, silicon dioxide, low k dielectric materials, tantalum, tantalum nitride, copper, tungsten, and aluminum. The polishing pad may be designed to selectively polish some materials and not others, to polish dissimilar materials at similar rates, or to work specifically with certain specific types of slurries and solutions. A seamless polishing pad according to the invention may be applicable in other industries, for example for polishing and planarizing magnetic disk drives, optical flats and mirrors. The seamless polishing pad is especially suited for the chemical-mechanical polishing of silicon and semiconductor wafers.

As previously stated, the seamless polishing pad includes a polishing layer 4 having a depth of penetration into subpad 3 that is substantially uniform. The uniformity of penetration of polishing layer 4 (and/or barrier 5) into subpad 3 can be measured according to the following protocol, which provides a penetration variation factor (PVF). Broadly, the polishing pad is cut open, and representative measurements are made of penetration depth with a caliper by viewing cross sections under a microscope (set to at least 30× magnification). Penetration depth is measured from the top surface of the subpad (i.e., the surface to which the hardenable fluid was applied). Because penetration nonuniformity may be caused by a change in viscosity of the hardenable fluid during its application to the subpad (i.e., material applied when viscosity is low may penetrate farther than material applied when viscosity is high), a representative distribution of subpad portions that were coated first, middle, and last with the hardenable fluid must be measured. For example, if a polishing pad is made by coating a subpad starting on one edge, continuing across the subpad, and ending at an opposite edge, then representative measurements should be made at equal distances from one edge to the other.

Further, at least about 40 measurements should be taken, so that the pad can be systematically evaluated over its entire area. For example, if a polishing pad was coated from one edge to the other, and the distance between the edges is 10 inches, then four equally spaced cross sections could be made perpendicular to those edges, and 10 measurements taken at 1-inch intervals along each cross section.

With those measurements in hand, the PVF is calculated by (a) throwing out the highest 2.5% of the measurements (where the polishing layer penetrated the greatest distance), and the lowest 2.5% of the measurements (where the polishing layer penetrated the least distance), (b) subtracting the lowest remaining measurement from the highest remaining measurement, and (c) dividing the result by the average thickness of the subpad. Hence, if 40 measurements are taken, then (a) the highest measurement and the lowest measurement are thrown out, (b) the lowest remaining measurement (the $2^{nd}$ lowest in the original set) is subtracted from the highest remaining measurement (the $2^{nd}$ highest in the original set), and (c) the result is divided by the average thickness of the subpad. Multiplying that result by 100% gives the PVF.

Preferably, the PVF of polishing layer 4 is less than about 75%. More preferably, the PVF of polishing layer 4 is less than about 50%. Still more preferably, the PVF of polishing layer 4 is less than about 25%. Even more preferably, the PVF of polishing layer 4 is less than about 10%. Yet more preferably, the PVF of polishing layer 4 is less than about 5%. Most preferably, the PVF of polishing layer 4 is less than about 1%.

Preferably, the PVF of barrier 5 is less than or equal to about 65%. More preferably, the PVF of barrier 5 is less than or equal to about 50%. Still more preferably, the PVF of barrier 5 is less than or equal to about 25%. Even more preferably, the PVF of barrier 5 is less than or equal to about 10%. Yet more preferably, the PVF of barrier 5 is less than or equal to about 5%. Most preferably, the PVF of barrier 5 is less than or equal to about 1%.

The seamless polishing pad often has a compressibility that is substantially uniform. One way to gauge compressibility uniformity is to measure peak durometer. Four equally spaced 2×2 inch samples should be cut from a region of the polishing pad that was coated first with the hardenable fluid. Four more equally spaced 2×2 inch samples should then be cut from a region of the polishing pad that was coated last with the hardenable fluid. Durometer measurements may be taken using a Shore A, B, C, or D gage, such as one manufactured by Rex Gauge Company (Buffalo Grove, Ill.). Each 2×2 inch sample is measured 5 times, recording the peak value each time, resulting in a total of 40 data points. Mean and standard deviation are calculated for the 40 durometer measurements, then within belt non-uniformity (WIBNU) is calculated by multiplying the standard deviation by 6, dividing by the mean, and multiplying by 100%.

Preferably, the durometer WIBNU of the polishing pad is less than or equal to about 10%. More preferably, the durometer WIBNU of the polishing pad is less than or equal to about 9%. Still more preferably, the durometer WIBNU of the polishing pad is less or equal to than about 8%. Even more preferably, the durometer WIBNU of the polishing pad is less than or equal to about 7%. Yet more preferably, the durometer WIBNU of the polishing pad is less than or equal to about 6%. Most preferably, the durometer WIBNU of the polishing pad is less than or equal to about 5%.

Another way to measure compressibility uniformity is to measure the stress at −0.05 strain. Three equally spaced 2×2 inch samples should be cut from a region of the polishing pad that was coated first with the hardenable fluid. Three more equally spaced 2×2 inch samples should then be cut from a region of the polishing pad that was coated last with the hardenable fluid. Compressive stress strain data should then be generated for each sample using the following experimental conditions. Each sample should be placed, substrate 1 side down, onto a 6 inch diameter stationary platen. The top surface of the sample should then be indented with a loading platen having a diameter of 0.5 inches. The testing may suitably be performed on an MTS 2/G (MTS Systems Corp. Minneapolis, Minn.) testing machine equipped with a 10 kN load cell. The experiments should be performed in displacement control at a constant displacement rate of 0.010 inches/minute. During the experiments, each sample should be compressed to a predefined displacement and then unloaded. The force and displacement of the top loading platen are recorded as a function of time. The force and displacement are then converted to engineering stress and strain by the following equations:

$$\sigma^{eng} = \frac{F}{A_0},$$

$$\varepsilon^{eng} = \frac{d}{L_0},$$

where

F=applied force (lbf)

$A_0$=cross-sectional area of the top loading platen ($in^2$)

d=displacement of the top loading platen $L_0$=initial thickness of the sample (in)

The stress at −0.05 strain is recorded for each sample. Mean and standard deviation are calculated for the 6 samples, and within belt non-uniformity (WIBNU) is calculated by dividing the standard deviation by the mean and multiplying by 100%.

Preferably, the stress/strain WIBNU of the polishing pad is less than or equal to about 35%. More preferably, the stress/strain WIBNU of the polishing pad is less than or equal to about 30%. Still more preferably, the stress/strain WIBNU of the polishing pad is less or equal to than about 25%. Even more preferably, the stress/strain WIBNU of the polishing pad is less than or equal to about 20%. Yet more preferably, the stress/strain WIBNU of the polishing pad is less than or equal to about 15%. Most preferably, the stress/strain WIBNU of the polishing pad is less than or equal to about 10%.

Although it is generally desirable, as stated above, to create a polishing pad having a substantially uniform compressibility, that is not always the case. It is sometimes desirable to create polishing pads having a non-uniform compressibility that is predictable. For example, it may be desirable to create a polishing pad having subpad that is thicker in some regions and thinner in others, and having a polishing layer that is thinner and thicker, respectively, in those respective regions. Such a polishing pad will intentionally have a nonuniform compressibility. But it is still preferred that the polishing layer 4 penetrates into the nonuniform subpad 3 to a uniform depth (measured from the top surface of the subpad, not the flat bottom). The present invention allows custom shapes like this to be made more predictably and consistently. A polishing pad with intentionally varying compressibility may give a desired blend of polishing performance, for example, from center to edge of a silicon wafer. In other words, the present invention is not limited to flat, rectangular subpads. The PVF of such a polishing pad could be measured by dividing the penetration depth range by the average thickness of the subpad, and would preferably correspond to the ranges quoted above.

According to the method of the present invention, a seamless polishing pad can be prepared by (a) providing a porous subpad, (b) applying a barrier to the subpad, and (c) coating the barrier-coated subpad with a hardenable fluid to form a seamless polishing layer. A seamless polishing pad also can be prepared by (a) providing a substrate, (b) attaching a porous subpad to the substrate, (c) applying a barrier to the subpad, and (d) coating the barrier-coated subpad with a hardenable fluid to form a seamless polishing layer. A seamless polishing pad also can be prepared by (a) providing a porous subpad, (b) applying a barrier to the subpad, (c) attaching the barrier-coated subpad to a substrate, and (d) coating the barrier-coated subpad with a hardenable fluid to form a seamless polishing layer. A seamless polishing pad also can be prepared by (a) providing a porous subpad, (b) applying a barrier to the subpad, (c) coating the barrier-coated subpad with a hardenable fluid to form a seamless polishing layer, and (d) attaching the polishing layer and barrier-coated subpad to a substrate.

A polishing pad prepared according to one of the above methods ("inventive polishing pad"), includes a polishing layer whose depth of penetration into the porous subpad is more uniform than the depth of penetration of the polishing layer in a polishing pad formed from the same materials according to the same method, but omitting the step where the barrier is applied ("the same polishing pad without the barrier"). The improvement in penetration depth uniformity can be measured by (a) subtracting the penetration variation factor (PVF) of the polishing layer of the inventive polishing pad from the PVF of the polishing layer of the same polishing pad without the barrier, and (b) dividing the result by the PVF of the polishing layer of the same polishing pad without the barrier. Preferably, the improvement in the PVF of the polishing layer of the inventive polishing pad is greater than or equal to about 10%. More preferably, the improvement in the PVF of the polishing layer of the inventive polishing pad is greater than or equal to about 30%. Still more preferably, the improvement in the PVF of the polishing layer of the inventive polishing pad is greater than or equal to about 50%. Even more preferably, the improvement in the PVF of the polishing layer of the inventive polishing pad is greater than or equal to about 70%. Yet more preferably, the improvement in the PVF of the polishing layer of the inventive polishing pad is greater than or equal to about 90%. Most preferably, the improvement in the PVF of the polishing layer of the inventive polishing pad is greater than or equal to about 99%.

A polishing pad prepared according to the method of the present invention ("inventive polishing pad") will often have an improved uniformity of compressibility as compared to a polishing pad formed from the same materials according to the same method, but omitting step (b) ("the same polishing pad without the barrier"). The improvement in uniformity of compressibility can be measured by (a) subtracting the durometer WIBNU of the inventive polishing pad from the durometer WIBNU of the same polishing pad without the barrier, and (b) dividing the result by the durometer WIBNU of the same polishing pad without the barrier. Preferably, the improvement in the durometer WIBNU of the inventive polishing pad is greater than or equal to about 5%. More preferably, the improvement in the durometer WIBNU of the inventive polishing pad is greater than or equal to about 15%. Still more preferably, the improvement in the durometer WIBNU of the inventive polishing pad is greater than or equal to about 30%. Even more preferably, the improvement in the durometer WIBNU of the inventive polishing pad is greater than or equal to about 45%. Yet more preferably, the improvement in the durometer WIBNU of the inventive polishing pad is greater than or equal to about 55%. Most preferably, the improvement in the durometer WIBNU of the inventive polishing pad is greater than or equal to about 65%.

The improvement in uniformity of compressibility also can be measured by (a) subtracting the stress/strain WIBNU of the inventive polishing pad from the stress/strain WIBNU of the same polishing pad without the barrier, and (b) dividing the result by the stress/strain WIBNU of the same polishing pad without the barrier. Preferably, the improvement in the stress/strain WIBNU of the inventive polishing pad is greater than or equal to about 10%. More preferably, the improvement in the stress/strain WIBNU of the inventive polishing pad is greater than or equal to about 25%. Still more preferably, the improvement in the stress/strain WIBNU of the inventive polishing pad is greater than or equal to about 40%. Even more preferably, the improvement in the stress/strain WIBNU of the inventive polishing pad is greater than or equal to about 55%. Yet more preferably, the improvement in the stress/strain WIBNU of the inventive polishing pad is greater than or equal to about 70%. Most preferably, the improvement in the stress/strain WIBNU of the inventive polishing pad is greater than or equal to about 85%.

EXAMPLE 1

A polishing belt was produced by casting a polyurethane polishing layer over a commercially available subpad material laminated to an endless stainless steel belt.

The endless stainless steel belt (substrate 1) was approximately 94 inches long, 13 inches wide, and 0.020 inches thick. The endless stainless steel band in this example was obtained from Belt Technologies Inc. (Agawam, Mass.).

Subpad 3 in this example was obtained from Thomas West Inc. (Sunnyvale, Calif.). The commercial designation for the subpad is 817. This material is a yellow colored non-woven material, impregnated with a soft elastomeric composition. Despite the impregnation, the subpad material still is porous and compressible. The subpad material was supplied with a rubber-based pressure sensitive adhesive laminated to one side. The subpad was obtained in rectangular pieces approximately 12 inches wide and 31.25 inches long. The thickness of the subpad and adhesive together was approximately 0.028 inches, where the subpad layer was approximately 0.022 inches thick, and the adhesive layer was approximately 0.006 inches thick.

Three pieces of the subpad were affixed, using the adhesive backing (adhesive 2), to the outside surface of the stainless steel belt. The subpad was positioned so that it was approximately centered between the edges of the stainless steel, leaving approximately 0.5 inches of exposed steel along both edges. Also the three pieces were positioned and trimmed if necessary to leave a gap of approximately 0.03-0.06" between the ends of the pieces.

The stainless steel and subpad laminate was placed on edge inside a cylindrical mold. The mold is constructed as two concentric cylinders positioned on a base plate. The top of the mold is open, and there are injection ports that come up through the base plate.

The mold containing the stainless steel and subpad laminate were preheated in an oven to the desired temperature for casting. Once the mold reached the desired temperature, the mold was injected with a hardenable fluid—a mixture of polyurethane resin (ADIPRENE® LF 750D available from Crompton Corporation, Middlebury, Conn.) and diamine curative (Ethacure 300 (E300) manufactured by Albemarle Corporation (Baton Rouge, La.). Casting and curing conditions, including amount of curative, process temperatures, and process times were set following guidelines published in LF 750D and E300 Product Data Sheets available from Crompton Corporation.

Polishing layer 4 solidifies within a few minutes after filling the mold. After approximately 10-15 minutes the part was removed from the mold and placed in an oven to complete the curing process. After the part was fully cured, it was removed from the oven and was allowed to cool to room temperature for further processing through a series of secondary operations necessary to trim the part to the desired final dimensions. The final resulting polishing belt has a seamless polishing layer, with grooves and buffed surface finish. The overall thickness is 0.085-0.091 inches, which includes the polishing layer thickness of 0.037-0.043 inches.

The finished belt was cut into pieces, and various pieces were used for qualitative peel testing, for measuring depth of penetration and durometer, and for generating compressive stress strain data.

Qualitative peel testing indicated that the bonding between the polishing layer and the subpad is very strong; the polishing layer could not be peeled away from the subpad layer without destroying the cohesiveness of the subpad itself.

Depth of penetration measurements were made by examining cross-sections at 11 locations across the width of the belt at each of 4 different locations, approximately 90 degrees apart, around the length of the belt. Therefore a total of 44 different locations were examined. Each sample piece examined was approximately 0.5 inches long. A microscope set to 30× magnification and a caliper were used to measure the depth of penetration of the polishing material into the subpad layer. Because there was a large amount of variation apparent within each sample, a maximum and a minimum depth of penetration were recorded for each of the 44 sample pieces, generating a total of 88 actual measurements. The maximum and minimum measurement for each sample were averaged to give a representative depth of penetration value for each sample. The 44 representative values were sorted from highest to lowest, then the effective range of penetration was determined after eliminating the highest 2.5% of the values and the lowest 2.5%. In this example, this resulted in elimination of 1 highest and 1 lowest value, leaving 42 values from which the effective range was determined. Once the effective range of penetration has been determined, a penetration variation factor was calculated by dividing the effective range of depth of penetration by the average thickness of the subpad layer. This variation factor will be larger for samples with large variations in penetration depth and it will be smaller for samples with more consistent depth of penetration. The belt in this example has a penetration variation factor (PVF) of 66%.

Durometer measurements were taken on 2×2 inch samples that were cut from the belt. Four samples were cut from a 3 inch wide region at the top edge of the belt, and 4 samples were cut from a 3 inch wide region at the bottom edge of the belt. These samples were spaced 2-4 inches apart along each edge. Top refers to the edge that was at the top of the mold during casting, and bottom refers to the edge of the belt that was at the bottom of the mold during casting. Durometer measurements were taken using a Shore C gage manufactured by Rex Gauge Company. Each 2×2 inch sample was measured 5 times, recording the peak value each time. Therefore a total of 40 data points were recorded for the belt in this example. Mean and standard deviation were calculated for the 40 Shore C measurements, then a measure of within belt non-uniformity (WIBNU) was calculated by multiplying 6 times the standard deviation then dividing by the mean. The belt in this example resulted in a WIBNU(6s)=9.9% for peak Shore C durometer.

Six additional 2×2 inch samples were cut from the belt for compressive testing. Three of the samples were taken from near the top edge and three from near the bottom edge of the belt. Compressive stress strain data were generated for each sample using the following experimental conditions. Each sample was tested in compression by placing the sample, steel side down, onto a 6 inch diameter stationary platen then indenting the top surface of the specimen with a loading platen having a diameter of 0.5 inches. The testing was performed on an MTS 2/G testing machine equipped with a 10 kN load cell. The experiments were performed in displacement control at a constant displacement rate of 0.010 inches/minute. During the experiments, each specimen was compressed to a predefined displacement and then unloaded. The force and displacement of the top loading platen were recorded as a function of time. The force and displacement were then converted to engineering stress and strain by the following equations:

$$\sigma^{eng} = \frac{F}{A_0},$$

$$\varepsilon^{eng} = \frac{d}{L_0},$$

where

F=applied force (lbf)

$A_0$=cross-sectional area of the top loading platen ($in^2$)

d=displacement of the top loading platen $L_0$=initial thickness of the sample (in)

The stress at −0.05 strain was recorded for each sample. Mean and standard deviation were calculated for the 6 samples, then a measure of within belt non-uniformity (WIBNU) was calculated by dividing the standard deviation by the mean. The belt in this example resulted in a WIBNU (1s)=37% for stress at −0.05 strain.

The above measurements indicate that the polishing material penetrated unevenly into the subpad layer and this resulted in variable compressive properties and durometer measurements. In addition it is logical to infer that other properties, such as dynamic mechanical properties, also would vary from point to point around the belt, given the non-uniform cross-sections.

EXAMPLE 2

The method of Example 1 was repeated using a different non-woven material as subpad 3. In this example, a non-woven material called AQUILINE™ and made by TEXON International (Leicester, England), was laminated on one side with the same rubber-based pressure sensitive adhesive 2 as was used in Example 1. The AQUILINE™ material comprises non-woven polyester fibers with much less impregnating material compared to the 817 material from Thomas West Inc. Comparing the two different subpad materials using a microscope or SEM shows that the AQUILINE™ material has a much more open structure and a higher degree of porosity than the 817. The AQUILINE™ subpad was cut into rectangular pieces approximately 12 inches wide and 31.25 inches long. The thickness of the subpad and adhesive together was approximately 0.038 inches, where the subpad layer was approximately 0.032 inches thick, and the adhesive layer was approximately 0.006 inches thick.

The same methods as described in Example 1 were followed to laminate the subpad to the stainless steel belt substrate 1, to prepare the mold, to cast the polishing layer 4, and to finish the polishing belt. The overall thickness was 0.085-0.091 inches, which includes the polishing layer thickness of 0.027-0.033 inches. The finished belt was cut up and subjected to the same host of tests as described in Example 1, with differences in numbers of samples and techniques noted below.

Qualitative peel testing indicated that the bonding between the polishing layer and the subpad is very strong; the polishing layer could not be peeled away from the subpad layer without destroying the cohesiveness of the subpad itself.

Depth of penetration measurements were performed at 77 different locations around the belt, 11 locations across the width at 7 different locations around the length. The depth of penetration observed within each 0.5 inch long sample was more uniform here than it was in Example 1, therefore only one representative penetration measurement was recorded for each sample instead of two. In this Example, a total of 4 points were thrown out to determine the effective range. The belt in this example has a PVF of 91%.

Durometer measurements (8 samples) and compressive stress strain measurements (6 samples) were obtained in the same manner as described in Example 1. The belt in this example resulted in a WIBNU(6s)=15% for peak Shore C durometer and a WIBNU(1s)=83% for stress at −0.05 strain.

The above measurements indicate that the polishing material penetrated unevenly into the subpad layer and this resulted in variable compressive properties and durometer measurements. In addition it is logical to infer that other properties, such as dynamic mechanical properties, also would vary from point to point around the belt, given the non-uniform cross-sections. Variability is even greater here than in Example 1.

EXAMPLE 3

The method of Example 2 was repeated, except that in this case a barrier 5 was applied to the AQUILINE™ subpad material prior to casting polishing layer 4. A barrier was achieved using a knife-over-roll technique to apply a polyurethane adhesive composition (D2596H Adhesive and D2597 Crosslinker, available from DELA, Inc.) to one side of the non-woven material prior to having the pressure sensitive adhesive laminated to the other side of the non-woven. The barrier material formed a very thin film at the top surface of the non-woven material, adopting the texture and topography of the non-woven and substantially sealing the top surface of the subpad layer. A single belt was used for qualitative peel tests, penetration measurements, hardness measurements, and compressive testing. Other polishing belts were prepared according to the same method, and were used to check lamination integrity on the belt roller apparatus depicted in FIG. 5.

Qualitative peel testing indicated that the bonding between the polishing layer and the subpad is very strong; the polishing layer could not be peeled away from the subpad layer without destroying the cohesiveness of the subpad itself. In addition, several belts according to this Example were run on a belt roller apparatus, as illustrated in FIG. 5, in order to check lamination integrity under dynamic, wet conditions. The belts were run at about 300 feet per minute over rollers (100,11) having a diameter of about 12 inches. Pressure was applied continuously to the top of the polishing belt by means of a urethane roller (8), weighing about 125 pounds, positioned above one of the mounting rollers (10) to create a nip through which the belt was continuously traveling. The contact area between the top roller and the top of the belt was about 12 inches by about 0.25 inches, thus giving an applied pressure of about 40 psi. Water was continuously poured onto the full width of the belt at a rate of about 1 liter per minute. After running for as long as 67 hours, the polishing belt showed no signs of delamination, i.e., there was no visible gap developing between the belt layers.

Figure 6:
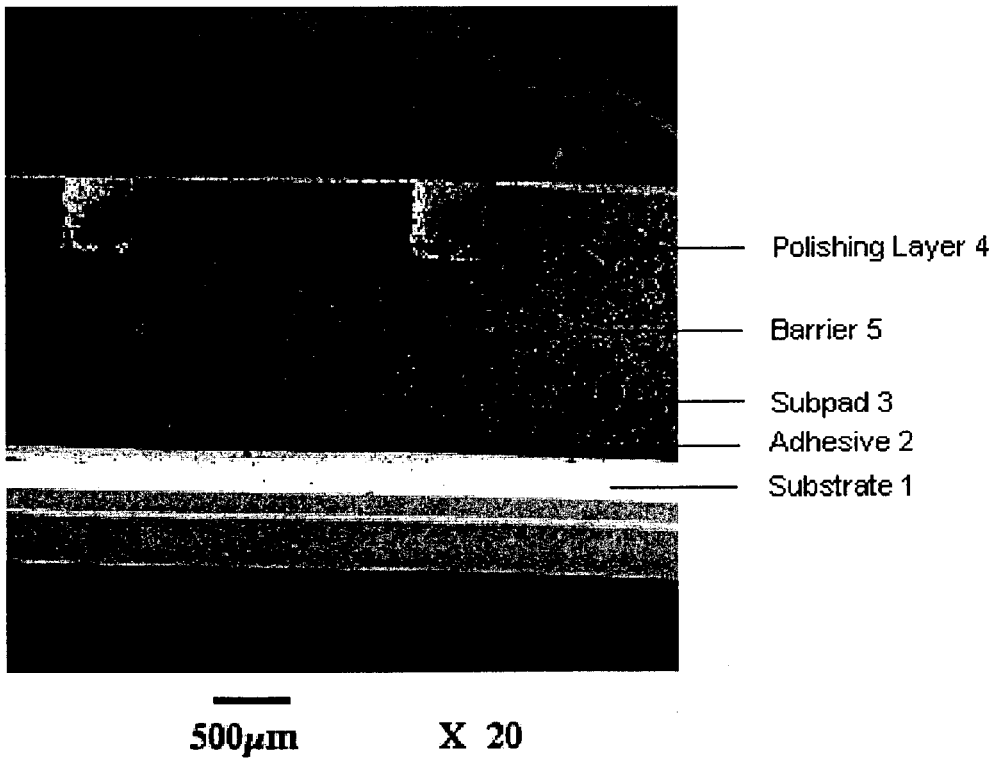
FIG. 6 depicts a scanning electron microscope (SEM) photomicrograph of a cross-section of the polishing pad of the present invention.
Figure 6A:
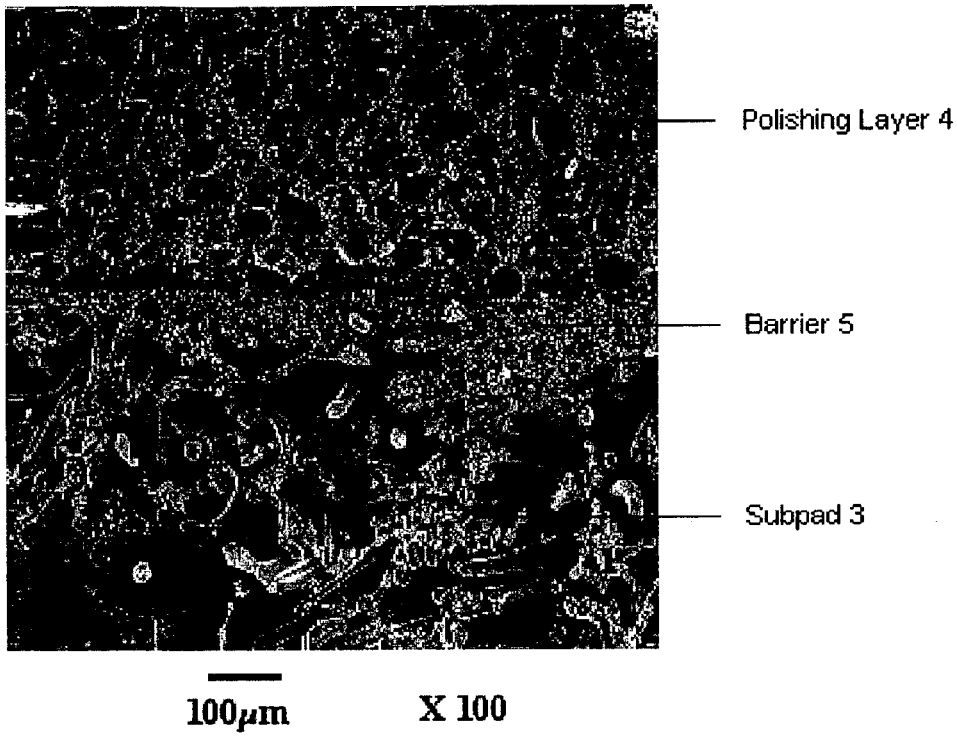
FIG. 6*a* depicts a scanning electron microscope (SEM) photomicrograph of a cross-section of the polishing pad of the present invention.

The depth of penetration into subpad 3 of both polishing layer 4 and barrier 5 were measured, and the PVF calculated, as described in Example 1. The polishing layer 4 did not penetrate past barrier 5. Barrier 5 had a consistent depth of penetration of between about 0.002 and about 0.004 inches. In other words, the PVF for the polishing layer was less than about 1%, while that of the barrier was about 6%. The substantial uniformity of penetration depth is depicted in FIGS. 6 and **6*a***, which show scanning electron microscope (SEM) photomicrographs of a representative cross-section of the polishing belt.

Durometer measurements (8 samples, 5 measurements per sample) and compressive stress strain measurements (6 samples) were obtained in the same manner as described in Example 1. The polishing belt in this example resulted in a WIBNU(6s)=5.0% for peak Shore C durometer and a WIBNU(1s)=11% for stress at −0.05 strain.

The polishing pad of this Example, which possessed barrier 5, had improved uniformity as compared to the polishing pad of Example 2, which did not possess barrier 5, but which was otherwise made of the same materials and according to the same method as the polishing pad of this Example. Namely, the PVF of polishing layer 4 improved by at least about 99% [(91−1)/91] (note that the improvement is at least about 93% [(91−6)/91] if the PVF of the barrier 5 is compared to Example 2), the peak Shore C durometer WIBNU improved by at least about 67% [(15−5)/15], and the stress at −0.05 strain WIBNU improved by at least about 87% [(83−11)/83]. In addition, it is logical to infer that other properties, such as dynamic mechanical properties, also would be more uniform around the polishing belt of this Example compared to the polishing belts of Examples 1 and 2. It is noteworthy that these increases in uniformity are achieved while maintaining the desired adhesion between polishing layer 4 and subpad 3.

EXAMPLE 4

A heavily saturated subpad material was prepared using the same materials and according to the same method as described in Example 3, with the following exception. In this Example, the AQUILINE™ subpad 3 was run through a bath containing the same barrier 5 in order to heavily load the subpad with the barrier material. The barrier-loaded subpad was then processed through nip rollers and cured prior to laminating one side with the rubber-based adhesive. Although the barrier 5 penetrated the full thickness of the subpad, the subpad was still porous, and was more compressible than a solid material. It is thought that the porosity resulted from the subpad expanding as it emerged from the nip rollers. Nevertheless, barrier 5 still prevented polishing layer 4 from penetrating into subpad 3.

If the PVFs and WIBNUs were measured as in Example 3, it is expected that the PVFs of both polishing layer 4 and barrier 5 were less than about 1%, and that the WIBNUs for peak Shore C durometer and stress at −0.05 strain were less than about 5% and less than about 10%, respectively. In other words, it is expected that the polishing pad of this Example, which possessed barrier 5, had improved uniformity as compared to the polishing pad of Example 2, which did not possess barrier 5, but which was otherwise made of the same materials and according to the same method as the polishing pad of this Example. Namely, it is expected that the PVF of polishing layer 4 improved by at least about 99% (and that the improvement was at least about 99% based on the PVF of the barrier 5), the peak Shore C durometer WIBNU improved by at least about 67%, and the stress at −0.05 strain WIBNU improved by at least about 88%.

EXAMPLE 5

Example 1 was repeated, except that in this case a barrier 5 was applied to the subpad 3 prior to casting the polishing layer 4. Namely, a thin layer of an acrylic adhesive, Chemlok® 213 was brushed evenly onto the surface of the subpad approximately 30 minutes prior to casting. The barrier 5 penetrated into subpad 3 to a depth of about 0.001 inches to about 0.002 inches. Polishing layer 4 did not penetrate past the barrier into the subpad. The polishing layer could not be separated from the subpad layer without destroying the cohesiveness of the subpad. The PVF for the barrier is approximately 4.5%.

If the PVFs and WIBNUs were measured as in Example 3, it is expected that the PVFs of polishing layer 4 and barrier 5 would be less than about 1% and less than about 5%, respectively, and that the WIBNUs for peak Shore C durometer and stress at −0.05 strain would be less than about 5% and less than about 10%, respectively. In other words, it is expected that the polishing pad of this Example, which possessed barrier 5, had improved uniformity as compared to the polishing pad of Example 1, which did not possess barrier 5, but which was otherwise made of the same materials and according to the same method as the polishing pad of this Example. Namely, it is expected that the PVF of polishing layer 4 improved by at least about 99% (and that the improvement was at least about 90% based on the PVF of the barrier 5), the peak Shore C durometer WIBNU improved by at least about 50%, and the stress at −0.05 strain WIBNU improved by at least about 70%.

EXAMPLE 6

Rectangular sheets of 817 subpad material, similar to the subpad material described in Example 1, were obtained from Thomas West, Inc. (Sunnyvale, Calif.). However these subpads had, as barrier 5, a pressure sensitive adhesive (PSA) applied to the top surface, in addition to the rubber-based pressure sensitive adhesive applied to the bottom surface. The PSA on the top surface was a double-sided tape routinely used in the lamination of the 817 subpad to polyurethane polishing pads, such as IC1000 polishing pads available from Rodel, Inc. (Newark, Del.). The subpad 3 was affixed to a stainless steel belt substrate 1, a polishing layer 4 was cast, and efforts were made to produce finished polishing belts as described in Example 1. However polishing layer 4, subpad 3 and the barrier 5 delaminated easily from each other—sometimes during removal from the mold, sometimes during machining, or sometimes during actual use, making the double-sided tape unsuitable for use as barrier 5 with the other elements of the polishing pad.

EXAMPLE 7

This Example demonstrates the use of five different polyurethane latexes as barrier 5. The different latexes, W-240, W-253, W-290, and W-505, all obtained from CK Witco Corp. (Greenwich, Conn.), were hand-brushed onto separate 4×12 inch subpads 3 (817 of Example 1) and allowed to dry in an oven overnight. The barriers 5 substantially adopted the surface topography of the subpads 3. The same urethane polishing layer 4 as was used in Example 1 was then poured over the top of each barrier-coated subpad, and the polishing layer 4 was allowed to cure. The elements of each polishing pad strongly resisted delamination.

Each polishing pad was checked for depth of penetration. In each of the polishing pads, the polishing layer 4 penetrated into barrier 5, but not beyond it. In the polishing pad created from the W-240 latex, the polishing layer 4 penetrated into subpad 3 to a depth that varied from about 0.001 to about 0.003 inches. In those created from the W-253, W-290, and W-505 latexes, the polishing layers 4 penetrated into subpads 3 to a depth that varied from about 0.001 to about 0.002 inches.

EXAMPLE 8

This Example demonstrates the use of a barrier 5 that is applied as a mixture of a reactive molecule and a reaction initiator therefor. A urethane prepolymer (ADIPRENE®

L100) and blocked curative (CAYTUR® 31), both obtained from Crompton Corporation (Middlebury, Conn.), were mixed together and then poured onto a 4×12 inch AQUI-LINE™ subpad 3. The mixture was worked into the subpad using a heavy steel rolling pin. The same hardenable fluid as used in Example 1 was poured over the barrier-coated subpad, which was then placed in an oven to initiate and complete the cure process. The resulting swatch was cut and examined for penetration. There was no penetration of the polishing layer 4 past the barrier 5, and the barrier itself had penetrated to a range of 0.015-0.020 inches. Adhesion between the layers was very good.

EXAMPLE 9

A full belt was manufactured by first fully impregnating the 817 subpad with a prepolymer and curative combination that was formulated to achieve a 30 shore A durometer. The 30A formulation was mixed and applied to the subpad by hand after the subpad was already affixed to the stainless steel belt. The 30A formulation was catalyzed to allow it to harden within a short period of time in the oven. Once the material had turned solid, the polishing layer was cast according to the method of Example 1. The final belt exhibited 100% penetration of the 30A barrier layer into the subpad. This was consistent at all locations around the belt. Zero range translates to a zero variation factor.

EXAMPLE 10

Smaller pads and a full belt were manufactured using spray polyurethane varnish as a barrier layer. Both light and heavy coats of the spray urethane appeared effective as a barrier layer and stopped polishing layer penetration into the subpad.

We claim:

1. A seamless polishing pad, comprising: a porous subpad layer having a seamless polishing layer thereon, wherein said polishing layer is a hardenable fluid cast onto said subpad layer which penetrates said subpad layer to a substantially consistent uniform depth, and wherein the within belt non-uniformity of a pad compressibility as measured by durometer is less than 10 percent.

2. The seamless polishing pad according to claim 1, wherein said seamless polishing layer is a hardenable fluid including at least one reactive molecule and at least one reaction initiator.

3. The seamless polishing pad according to claim 1, wherein said seamless polishing layer is a hardenable fluid including a polymer dissolved in a solvent.

4. The seamless polishing pad according to claim 1, wherein said seamless polishing layer is cast onto said subpad and cured.

5. A method of making a seamless polishing pad, comprising:

providing a porous subpad layer; and a seamless polishing layer disposed thereon, wherein said seamless polishing layer penetrates said porous subpad layer to a substantially consistent uniform depth, and wherein the within belt non-uniformity of a pad compressibility as measured by durometer is less than 10 percent.

6. A method of making a seamless polishing pad according to claim 5, further comprising:

introducing a barrier layer between said seamless polishing layer and said subpad layer, wherein said barrier layer and seamless polishing layer penetrate into said subpad layer to a substantially uniform depth.

7. The method of making a seamless polishing pad according to claim 6, wherein said seamless polishing layer is cast onto said barrier layer.

8. The method of making a seamless polishing pad according to claim 5, wherein said seamless polishing layer is coated or cast onto said subpad layer.

9. The method of making a seamless polishing pad according to claim 5, further comprising:

introducing said subpad layer, optionally having a barrier layer disposed thereon, into a mold; and heating said mold to a predetermined temperature and filling said mold from through a top opening, or through injection ports, to cast a hardenable fluid onto said subpad or barrier layer, thereby forming a polishing layer which penetrates into said subpad layer at a substantially uniform depth.

* * * * *